United States Patent [19]

Klisch et al.

[11] Patent Number: 4,554,098

[45] Date of Patent: Nov. 19, 1985

[54] MILD LIQUID DETERGENT COMPOSITIONS

[75] Inventors: Stephen C. Klisch, Somerset; Kuo-Yann Lai, Kendall Park; Clarence R. Robbins, Piscataway, all of N.J.

[73] Assignee: Colgate-Palmolive Company, New York, N.Y.

[21] Appl. No.: 350,497

[22] Filed: Feb. 19, 1982

[51] Int. Cl.[4] ..... C11D 1/84; C11D 1/14

[52] U.S. Cl. ..... 252/547; 252/153; 252/545; 252/548; 252/550; 252/551; 252/552; 252/553; 252/554; 252/555; 252/558; 252/DIG. 14

[58] Field of Search ..... 252/545, 546, 547, 548, 252/551, 153, 552, 554, 553, 555, 557, 558, DIG. 14, 550

[56] References Cited

U.S. PATENT DOCUMENTS

| | | | |
|---|---|---|---|
| 3,755,206 | 8/1973 | Verdier | 252/545 |
| 3,793,233 | 2/1974 | Rose et al. | 252/547 |
| 3,898,186 | 8/1975 | Mermelstein et al. | 252/528 |
| 3,944,663 | 3/1976 | Weiss et al. | 424/78 |
| 3,950,417 | 4/1976 | Verdicchio et al. | 252/545 |
| 4,092,273 | 5/1978 | Inamorato et al. | 252/548 |
| 4,221,733 | 9/1980 | Melloh et al. | 260/404.5 |

FOREIGN PATENT DOCUMENTS

| | | |
|---|---|---|
| 1277495 | 9/1968 | Fed. Rep. of Germany . |
| 2612095 | 10/1976 | Fed. Rep. of Germany . |
| 3011549 | 10/1981 | Fed. Rep. of Germany . |
| 7304068 | 10/1973 | Netherlands . |
| 797119 | 6/1958 | United Kingdom . |

*Primary Examiner*—Prince E. Willis

*Attorney, Agent, or Firm*—Richard N. Miller; Murray M. Grill; Herbert S. Sylvester

[57] ABSTRACT

Liquid detergent compositions having good foaming and grease emulsification properties as well as reduced skin irritation effects which consist essentially of, by weight, 8% to 30% of a water-soluble $C_{10}$—$C_{16}$ alkyl ether ethylenoxy sulfate salt containing an average of 5 to 12 moles of ethylene oxide in the molecule, a supplementary, water-soluble, non-soap, anionic detergent having in its molecular structure a $C_8$—$C_{22}$ alkyl alkenyl or acyl group, and a sulfonate, sulfate or carboxylate group, the weight ratio of said alkyl ether sulfate to said supplementary detergent being in the range of 1:1 to 20:1; 1% to 8% of a zwitterionic detergent having the structural formula

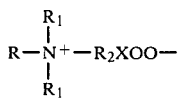

wherein R is a $C_8$—$C_{18}$ alkyl or $C_8$—$C_{18}$ alkanamido $C_2$—$C_3$ alkyl group, $R_1$ is a $C_1$—$C_3$ alkyl, $R_2$ is a $C_1$—$C_4$ alkylene or hydroxyalkylene and X is S:O or C; 1% to 8% of an N—$C_8$—$C_{18}$ alkonoic acid $C_2$—$C_3$ alkanolamide, the weight ratio of said alkanolamide to said zwitterionic detergent being in the range of 1:4 to 4:1; and the balance being an aqueous medium comprising water and from 2% to 20% of a solubilizer selected from the group consisting of $C_2$—$C_3$ alcohols, hydrotropes and mixtures thereof. Preferred compositions include, in addition, 2% to 10% by weight of an anti-gelling agent, such as a water-soluble formate. These compositions are characterized by good foaming, cleaning and skin mildness characteristics and are suitable for use as shampoos, dishwashing liquids, liquid soaps and foam baths.

10 Claims, No Drawings

MILD LIQUID DETERGENT COMPOSITIONS

FIELD OF THE INVENTION

This invention relates to a high-foaming liquid detergent composition which exhibits reduced detergent irritation effects when brought in contact with the skin. The inventive compositions exhibit good foaming characteristics, e.g., copious foam volume and good foam stability in the presence of grease soil, but are milder to the skin, i.e., cause less skin irritation, than currently available liquid detergents containing anionic sulfonated detergents. Thus, the inventive liquid compositions are particularly suitable for use as hand dishwashing detergents, shampoos, liquid soaps and foam baths.

BACKGROUND OF THE INVENTION AND PRIOR ART

Because of the known deleterious effects of the commonly used anionic detergents on the skin, research and development efforts continue unceasingly in an attempt to formulate milder liquid detergent compositions, i.e., liquid compositions exhibiting reduced skin-irritation effects.

Generally, research efforts have fallen in three categories. The first category embraces the efforts to formulate milder liquid detergent compositions by utilizing specific mixtures of particular surfactants in specific proportions. For example, U.S. Pat. No. 3,223,647 discloses mixtures of $C_9$—$C_{15}$ alkylbenzene sulfonate and tertiary amine oxide in 20:1 to 1:5 proportions which exhibit reduced skin irritation effects. Further, U.S. Pat. No. 3,793,233 discloses mild liquid compositions containing specific proportions of an alkyl ether sulfate containing 5–12 ethylene oxide groups in the molecule, a lauryl sulfate detergent, an alkyl glyceryl ether sulfonate detergent and a trialkyl amine oxide. Similarly, U.S. Pat. No. 3,943,234 discloses a mild liquid surfactant containing trialkyl amine oxide in combination with an anionic sulfate detergent. The foregoing compositions are described as mild because the trialkyl amine oxide reduces the skin irritating effects of the lauryl sulfate and $C_9$—$C_{15}$ alkyl benzene sulfonate detergents. However, such compositions are not completely satisfactory and the essential amine oxide surfactants may form nitrosamines which may be carcinogens.

The second category of research embraces the attempts to reduce the skin irritating effects of water-soluble anionic detergents containing sulfate, sulfonate and carboxylate solubilizing groups by addition of a specific compound. For example, U.S. Pat. No. 3,548,056 describes the addition of a protein hydrolysate having a gel strength of 0 Bloom grams to dishwashing liquids containing $C_9$—$C_{15}$ alkylbenzene sulfonate to reduce skin irritation. Similarly, U.S. Pat. No. 4,087,518, British Pat. No. 1,122,076 and U.S. Pat. No. 4,115,548 describe the use of other protein hydrolysates or derivatives thereof to reduce the skin irritation effects of anionic sulfonate and sulfate detergents. Additionally, U.S. Pat. No. 3,944,663 discloses addition of polyethylene oxide to liquid detergents containing a mixture of $C_9$—$C_{15}$ alkylbenzene sulfonate and $C_{12}$—$C_{15}$ alkyl ether triethylenoxy sulfate to reduce the skin irritation characteristics of the liquids. However, these approaches have achieved limited success and tend to be expensive because of the high cost of the added component.

The third category of research concerns the substitution of alternative surfactants, e.g., ampholytic surfactants, nonionic surfactants, etc., for the high foaming anionic sulfate, sulfonate and carboxylate detergents. However, this approach, too, has not been successful because the ultimate products either are too costly or exhibit reduced foaming characteristics.

The present invention represents another improvement in the first category because it relates to liquid compositions which exhibit enhanced mildness, i.e., reduced skin irritation effects, without reduced foam volume and/or foam stability and/or grease emulsification properties and are based upon use of controlled proportions of specific surfactants.

SUMMARY OF THE INVENTION

As indicated above, the present invention primarily resides in the discovery that high foaming liquid detergent compositions which exhibit enhanced mildness, i.e., reduced skin irritation effects, can be achieved without any substantial sacrifice in foaming properties, e.g, foam volume and foam stability in the presence of soil, if selected proportions of four surfactants are employed. To the extent that the resultant compositions do not contain trialkyl amine oxides and do include skin-irritating sulfate, sulfonate and carboxylate detergents as one of the essential components, the achievement of liquids of improved mildness is surprising.

Broadly the present invention relates to a high foaming, liquid detergent composition having reduced skin-irritation properties which consist essentially of, by weight, 8% to 30% of an alkyl ether sulfate having the structural formula $R(OC_2H_4)_nOSO_3M$ wherein R is an alkyl of 10 to 16 carbon atoms, n has an average value of 5 to 12 and M is a cation; a supplementary, water-soluble, non-soap, anionic detergent having in its molecular structure a $C_7$—$C_{22}$ alkyl, alkenyl or acyl group and a sulfonate, sulfate or carboxylate group, the weight ratio of said alkyl ether sulfate to said supplementary detergent being in the range of 1:1 to 20:1; 1% to 8% of a zwitterionic detergent having the structural formula

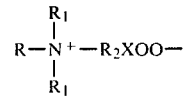

wherein R is a $C_8$—$C_{18}$ alkyl or $C_8$—$C_{18}$ alkanamido $C_2$—$C_3$ alkyl group, $R_1$ is $C_1$—$C_3$ alkyl, $R_2$ is a $C_1$—$C_4$ alkylene or hydroxyalkylene and X is S:O or C; 1% to 8% of an N-$C_8$—$C_{18}$ alkanoic acid $C_2$—$C_3$ alkanolamide, the weight ratio of alkanolamide to said zwitterionic detergent being in the range of 1:4 to 4:1; and the balance being an aqueous medium comprising water and from 2% to 20% of a solubilizer selected from the group consisting of $C_2$—$C_3$ monohydric and polyhydric alcohols, water-soluble $C_1$—$C_3$ alkyl substituted benzene sulfonate salts, urea and mixtures thereof.

In a preferred aspect, the foregoing composition contains, in addition, 2% to 10% by weight of an anti-gelling agent selected from the group consisting of water-soluble salts, e.g., sodium, potassium, ammonium, etc., of formate and isethionate. More specifically, the inclusion of the anti-gelling agent results in compositions having reduced tendencies to form surface films and gels upon exposure to the atmosphere for up to twenty-four hours as compared with current present-day, commercially mild, dishwashing liquids.

DETAILED DESCRIPTION OF THE INVENTION

The principal detergent component in the inventive liquid compositions is the water-soluble salt of a sulfuric acid ester of the reaction product of one mole of a $C_{10}$—$C_{16}$ alkanol with 5 to 12 moles of ethylene oxide. These detergents are described in the prior art as alkyl ether sulfates of the following structural formula:

$$R(OC_2H_4)_nOSO_3M$$

wherein R is an alkyl containing about 10 to about 16 carbon atoms, n has an average value of 5 to 12 and M is a cation. Usually, the cation will be selected from the group consisting of sodium, potassium, ammonium and mono-, di- and triethanolammonium.

The methods of making the alkyl ether sulfate detergent are well known and described in issued patents. For example, the alkyl ether sulfates can be prepared by sulfating and neutralizing the reaction product of 5 to 12 moles of ethylene oxide with one mole of a $C_{10}$—$C_{16}$ alkanol. Condensation of ethylene oxide and an alkanol usually is carried out under pressure in the presence of an acidic catalyst, e.g., boron trifluoride, or alkaline catalyst, e.g., sodium hydroxide. Such reaction yields a mixture of alkyl ethoxylates of varying ethylene oxide content, i.e., from one or two ethylene oxide groups per mole of alkanol to a number of ethylene oxide groups per mole of alkanol which is equal to about twice the number of moles of ethylene oxide reacted with the alkanol, with the predominant alkyl ethoxylate containing the number of moles of ethylene oxide originally reacted with the $C_{10}$—$C_{16}$ alkanol. Thus, n in the formula designates the number of moles of ethylene oxide reacted with the alkanol. Sulfation of the resultant alkanol ethoxylates is achieved in a known manner using sulfur trioxide or chlorosulfonic acid as the sulfating agent. Similarly, neutralization of the sulfated product is carried out in a known manner using an aqueous base such as sodium hydroxide, ammonium hydroxide, etc.

The alkyl ether sulfate component exhibits cleaning and foaming properties and desirable mildness properties. Preferably, the alkyl ether sulfates will contain 12 to 14 carbon atoms in the alkyl group and will be employed in the form of the sodium or ammonium salt. Examples of suitable alkyl ether sulfates are sodium $C_{12}$—$C_{14}$ alkyl ethylenoxy (6.5) sulfate, ammonium $C_{12}$—$C_{14}$ alkyl ether ethylenoxy (6.5) sulfate, sodium $C_{12}$—$C_{14}$ alkyl ether ethylenoxy (9.5) sulfate, sodium $C_{12}$—$C_{14}$ alkyl ether ethylenoxy (11.4) sulfate, potassium $C_{12}$—$C_{16}$ alkyl ether ethylenoxy (6.5) sulfate, ammonium $C_{12}$—$C_{13}$ alkyl ether ethylenoxy (6.5) sulfate and ammonium $C_{12}$—$C_{16}$ alkyl ether ethylenoxy (7) sulfate. Preferred alkyl ether sulfates are the sodium and ammonium $C_{12}$—$C_{13}$ or $C_{12}$—$C_{14}$ alkyl ether ethylenoxy (6.5–9) sulfates.

Generally, the mild liquid detergent compositions will contain from about 8% to 30%, preferably 12% to 24%, by weight of the alkyl ether sulfate detergent.

In addition to the primary alkyl ether sulfate detergent, the liquid composition also will include about 1% to 12%, preferably 2% to 10%, by weight of a water-soluble, supplementary, anionic detergent for the purpose of improving the detergency and foaming properties of the primary detergent. Generally, the supplementary detergent improves both the foam stability and foam volume of the primary detergent. However, the supplementary detergent has the disadvantage of being more irritating than the primary detergent which is characterized by its mildness. Thus, the concentration of the supplementary detergent is related to the concentration of the primary detergent, and the weight ratios of primary detergent to supplementary detergent usually range from about 1:1 to about 20:1, preferably 1.5:1 to 6:1.

Satisfactory supplementary detergents are water-soluble, non-soap, anionic detergents having in their molecular structure a $C_7$—$C_{22}$ alkyl, alkenyl or acyl group and a sulfonate, sulfate or carboxylate group. Such detergents are employed in the form of water-soluble salts and the salt-forming cation usually is selected from the group consisting of sodium, potassium, ammonium, and mono-, di- or tri-$C_2$—$C_3$ alkanolammonium, with the sodium and ammonium cations again being preferred.

The suitable supplementary anionic detergents include the following:

1. The $C_8$—$C_{18}$ alkyl sulfates which are usually obtained by sulfating $C_8$—$C_{18}$ alkanols obtained by reducing the glycerides of tallow or coconut oil. Preferred alkyl sulfates contain 10 to 16 carbons in the alkyl group.

2. The $C_9$—$C_{15}$ alkylbenzene sulfonates wherein the alkyl group is either a straight chain or a branched chain, with the straight chain being preferred for its improved biodegradability.

3. The $C_8$—$C_{22}$ olefin sulfonates which may be obtained by sulfating the appropriate olefin. Preferred olefin sulfonates contain from 14 to 16 carbon atoms in the alkyl group and are obtained by sulfonating an $\alpha$-olefin.

4. The $C_8$—$C_{18}$ alkyl ether ethylenoxy sulfates of the formula $$R(OC_2H_4)_nOSO_3M$$

wherein n is 1 to 4. These sulfates differ from the primary alkyl ether sulfate detergent in the number of moles of ethylene oxide (1–4) reacted with one mole of alkanol in forming the ethoxylated alkanol which is sulfated and neutralized to form this anionic detergent. Preferred alkyl ether ethylenoxy sulfates contain 12 to 16 carbon atoms in the alkyl group and contain two to three ethylene oxide groups per mole of alkanol.

5. The $C_{10}$—$C_{20}$ paraffin sulfonates obtained, for example, by reacting an $\alpha$-olefin with bisulfite. Preferred alkane sulfonates contain 13 to 17 carbon atoms in the alkyl group.

6. The $C_6$–$C_{12}$ phenyl ether polyethylenoxy sulfates containing from 2 to 6 moles of ethylene oxide in the molecule may be used, too. These detergents can be prepared by reacting an alkyl phenol with 2 to 6 moles of ethylene oxide and sulfating and neutralizing the resultant ethoxylated alkylphenol. Preferred detergents in this group have 8 to 12 carbons in the alkyl group and contain about 4 ethylene oxide groups in the molecule.

7. The $C_8$—$C_{18}$ alkyl sulfoacetates corresponding the formula $$ROOCCH_2SO_3M$$

wherein R is a $C_8$–$C_{18}$ alkyl which may be prepared by esterifying an alkanol with chloroacetic acid or chloroacetyl chloride and then reacting the chloroester with a sodium or potassium bisulfite. Preferred sulfoacetates contain 12 to 16 carbon atoms in the alkyl group.

8. The N-mono-$C_8$—$C_{22}$ alkyl (includes alkyl groups interrupted by an ether or amido group) sulfosuccinates prepared by reacting, for example, either one mole of $C_8$—$C_{18}$ alkanol or a $C_8$—$C_{18}$ alkoxy $C_2$—$C_3$ alkanol or a $C_8$—$C_{18}$ alkanamido $C_2$—$C_3$ alkanol with maleic acid and reacting the resultant product with an alkali metal bisulfite to form an N-mono-$C_8$—$C_{22}$ alkyl sulfosuccinate. It should be recognized that the alkyl group of product made from the N-acyl alkanolamine will contain an amido intermediate linkage. Similarly, the alkyl group may be interrupted by an ether linkage or ester linkage if an alkyl ether ethanol or an alkyl ester of ethylene glycol is reacted with maleic acid. Preferred sulfosuccinates are disodium N-mono-$C_8$—$C_{18}$ acylisopropanolaminosulfosuccinate, disodium lauryl sulfosuccinate and N-monooleylisopropanolaminosulfosuccinate.

9. The N-$C_8$—$C_{18}$ acyl sarcosines may be produced by neutralizing the reaction product of a $C_8$—$C_{18}$ alkanoic acid with N-methyl glycine. Preferred sarcosinates contain 12 to 14 carbon atoms in an acyl group obtained by reduction of coconut oil.

10. The N-$C_8$—$C_{18}$ acyl taurines may be produced by neutralizing the reaction product of a $C_8$—$C_{18}$ alkanoic acid with aminoethylsulfonic acid. Again, preferred taurates contain 12 to 14 carbon atoms in an acyl group obtained by reduction of coconut oil.

11. The O-$C_8$—$C_{18}$ acyl isethionates may be produced by neutralizing the reaction product of a $C_8$—$C_{18}$ alkanoic acid with 2-hydroxyethanesulfonic acid. Similar to the sarcosines and taurines, the preferred isethionates contain 12 to 14 carbon atoms in an acyl group obtained by reduction of coconut oil.

As indicated above, the proportion of the supplementary anionic detergent must be controlled if the final composition is to be mild to the skin because the supplementary anionic detergents are more irritating to the skin than the principal alkyl ether sulfate detergent. For example, the patent art clearly indicates that $C_8$—$C_{18}$ alkyl sulfates and $C_9$—$C_{15}$ alkyl benzene sulfonates are irritating to the skin. Furthermore, the other supplementary anionic detergents suitable for use herein also are irritating to the skin, but usually to a lesser degree than the alkyl sulfate and alkylbenzene sulfonate detergents. Although the supplementary detergents are included to improve the foaming and detergency properties of the inventive liquid compositions, it should be understood that the concentration present will be maintained at the minimum level consistent with the desired performance characteristics in order to preserve the mildness of the final product. Thus, the proportions of the individual supplementary anionic detergents are variable and will be based upon an appropriate integration of foaming, cleaning and mildness properties of the individual supplementary detergents with the principal alkyl ether sulfate detergent.

The third essential ingredient in the inventive, mild, liquid compositions is a zwitterionic detergent corresponding to the formula

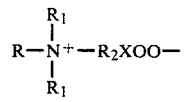

wherein R is a $C_8$—$C_{18}$ alkyl or $C_8$—$C_{18}$ alkanolamido $C_2$—$C_3$ alkyl, $R_1$ is $C_1$—$C_3$ alkyl, $R_2$ is a $C_1$—$C_4$ alkylene or $C_1$—$C_4$ hydroxy alkylene and X is C or S:O. When X is C, the detergent is called a betaine, and when X is S:O, the detergent is called a sultaine or sulfobetaine. These zwitterionic detergents can be described broadly as derivatives of aliphatic quaternary ammonium or tertiary sulfonium compounds containing a $C_8$—$C_{18}$ aliphatic radical which may be straight chained or branch chained and containing an anionic group. Preferred betaine and sultaine detergents are lauryldimethylammonioacetate, myristyldimetylammonioacetate, $C_8$—$C_{18}$ alkanamidopropyldimethylammonio acetate 1-(myristyldimethylammonio)-propane-3-sulfonate and 1-(myristyldimethylammonio)-2-hydroxypropane-3-sulfonate.

In the inventive compositions, the zwitterionic detergent acts as both a foam builder and as a counter-irritant detergent. Generally, the proportion of zwitterionic detergent in the liquid compositions will range from 1% to 8%, preferably 2% to 6%, by weight. Further, the proportion of zwitterionic detergent will be integrated with the proportion of the supplementary anionic detergent in view of its apparent counter irritant effects and, desirably, the weight ratio of zwitterionic to supplementary anionic will be from 2:1 to 1:3. Additionally, the zwitterionic detergent concentration will be coordinated with the alkanoic acid alkanolamide foam booster in order to achieve liquid compositions of optimum foam stability.

The final essential ingredient in the mild liquid detergent compositions will be a $C_8$—$C_{18}$ alkanoic acid $C_2$—$C_3$ alkanolamide. This component is widely recognized as a foam builder and satisfactory alkanoic acid alkanolamides are lauric monoethanolamide, myristic monoethanolamide, lauric diethanolamide, myristic diethanolamide, lauric isopropanolamide and coconut ($C_8C_{18}$) monoethanolamide. Preferred alkanoic acid alkanolamides contain 12 to 14 carbons in the fatty acyl group. A particularly preferred compound is lauric-myristic monoethanolamide.

As stated above, the proportions of the essential alkanoic acid alkanolamide and the essential zwitterionic detergent are controlled in the range of 1:4 to 4:1, preferably from 1:2 to 2:1 in order to achieve optimum foam stability. Both the zwitterionic detergent and alkanoic acid alkanolamide must be present because the desired foam stability cannot be achieved when only one of these compounds is present. Usually, the amount of alkanoic acid alkanolamide in the liquid detergent composition will be 1% to 8%, preferably 2% to 6%, by weight.

Usually, the balance of the liquid composition will be an aqueous medium comprising water and about 2% to 20%, preferably 4% to 14%, by weight of a solubilizer selected from the group of $C_2$—$C_3$monohydric and polyhydric alcohols, water-soluble $C_1$—$C_3$ alkyl substituted benzene sulfonates, urea and mixtures thereof. Suitable monohydric alcohols are ethanol and isopropanol, with ethanol being preferred. Suitable $C_1$—$C_3$ alkylbenzene sulfonates are sodium, potassium and ammonium salts such as sodium xylene sulfonate, potassium toluene sulfonate and sodium isopropylbenzene sulfonate. Typically, the solubilizer is selected to provide clarity and/or low-temperature cloud point and/or to control viscosity. Since the alcohol and sulfonate solubilizers do not exhibit the same effects, usually the liquid compositions herein will contain a mixture of alcohol and hydrotropic sulfonate. Also, urea may be included as a solubilizer where the desired low-temperature cloud temperature or viscosity cannot be achieved in its absence.

In the preferred liquid compositions, from 2% to 10%, preferably, 4% to 8%, by weight of an anti-gelling agent selected from the group consisting of sodium, ammonium or potassium formate and sodium, ammonium or potassium isethionate will be present. Such agent inhibits the tendency of the liquid compositions to form surface films and gels when the composition is in contact with the atmosphere for up to twenty-four hours—a condition which might occur if the cap inadvertently is left off of a container of a product after use. Gelling is determined by pouring 30 millileters (ml) of product into a 50 ml. beaker and observing the surface and contents after ¼, ½, 1, 2, 3, 4, 5, 6, 7 and 24 hours. The product is rated for film and/or gel formation on a scale of 0 to 10 at each observation. The gel value is the sum of the ratings. Compositions containing the anti-gelling agent exhibit superior anti-gelling tendencies as compared with a leading mild liquid detergent.

The described mild liquid compositions are essentially unbuilt liquids, i.e., do not contain proportions of organic or inorganic builder salt in detergent building proportions, and, therefore, are suitable for use as liquid, hand dishwashing detergents, liquid shampoos, liquid hand soaps and foam or liquid shower bath products. Thus, these inventive compositions can contain any of the usual adjuvants found in those compositions provided that they do not interfere with the mildness or performance properties of the imventive liquids. Such additional ingredients include minor proportions of perfumes and colors for aesthetic purposes, opacifiers such as ethylene glycol distearate or polystyrene, thickening agents such as gums or hydroxypropyl methyl cellulose, sequestering agents such as citrate or ethylenediamine tetraacetate, preservatives such as formaldehye or Dowicil ®200 or monomethyloldimethyl hydantoin, fluorescent agents or optical whiteners, magnesium sulfate and inert salts such as sodium sulfate. The total concentration of added ingredients usually will be less than 5%, preferably less than 3%, by weight of the total composition.

These compositions are prepared by admixing the individual detergent ingredients with the formula weight of water with agitation at a temperature in the range of about 32° C. to 65° C. Usually the individual detergents are added in the form of aqueous solutions or dispersions. Typically, the alkanoic acid alkanolamide is added in liquid form as one of the last ingredients at a temperature below about 55° C. Also, when present, the anti-gelling agent is added to the formula weight of water as the first ingredient or to a surfactant-water mixture in order to dissolve it. Additionally, it is desirable to add any solubilizing agent to the formula weight of water prior to the addition of the essential detergent ingredients in order to avoid formation of gels. Any additional ingredients, such as color and perfume usually are added with agitation after the alkanolamide while cooling the mixture to 25° C. to 32° C. temperature. The pH is usually adjusted, if necessary, to a pH in the range of 5–9, preferably 6.5–8.5, for dishwashing and shampoo products by addition of, for example, either sulfuric acid or citric acid or sodium hydroxide, potassium hydroxide or triethanolamine. Further, any adjustment of viscosity may be achieved by adding additional amounts of the appropriate solubilizers or thickening agents.

Usually, the viscosity of the liquid compositions will be variable over the range of about 20 centipoises (cps) to 2000 cps., and preferably from 75 cps. to 1000 cps. Viscosity is measured using a Brookfield Viscometer, Model LVF, with a #1 spindle rotating at 12 r.p.m. The most preferred viscosity range is 150 cps. to 350 cps. based upon current consumer preferences. However, it will be recognized by one skilled in the art that liquids of even higher viscosity can be achieved by including up to 2% by weight of a known thickening agent in the inventive compositions.

The foaming and grease emulsification characteristics of the inventive liquid compositions are illustrated in the following dishwashing test. In this test, ceramic dinner plates having a diameter of nine and one-half inches soiled with about 4 grams of Crisco ® or about 15 grams of Ragu ® spaghetti sauce soil are washed at thirty second intervals in a dishpan containing either six grams (0.1%) or 12 grams (0.2%) of liquid composition dissolved in six liters of water of a selected hardness at a temperature of about 46° C. (Six grams of detergent are employed when each plate is soiled with Ragu ® spaghetti sauce and twelve grams are employed when each plate is soiled with Crisco at the beginning of the test.) A layer of foam is generated by allowing the six liters of water to fall from a separatory funnel mounted sixteen inches above the bottom of the dishpan into a Petri dish containing the liquid composition to be tested which is located in the center of the dish pan. The Petri dish is removed carefully and the foam height is measured prior to the start of the test. A soiled dish is placed in the solution every thirty seconds and is washed by the operator for 10 to 15 seconds while holding it about half in and half out of the solution. Washing continues until about one half of the surface of the dish pan is covered with foam. Usually, a control is run at the same time as the test product in order to eliminate any differences due to different operators. Results are reproducible and a difference of 2 plates is considered to be significant.

Specific inventive liquid compositions are illustrated by the following examples. All quantities indicated in the examples or elsewhere in the specification are by weight unless otherwise indicated.

EXAMPLE 1

A preferred dishwashing liquid composition according to this invention follows:

| | % by weight |
|---|---|
| Sodium $C_{12}$–$C_{14}$ alkyl ether ethylenoxy (6.5) sulfate[a] | 16 |
| Ammonium lauryl sulfate | 6 |
| Cocoamidopropyldimethylbetaine | 4 |
| Lauric-myristic monoethanolamide | 3 |
| Ethanol | 4 |
| Sodium xylene sulfonate | 1.8 |
| Sodium formate | 6.0 |
| Hydroxyethyl ethylene diamine tri-acetic acid, tri-sodium salt (HEDTA) | 0.2 |
| Water, color, perfume | balance |
| | 100.0 |

(a)Weight ratio of $C_{12}$ to $C_{14}$ is 82% to 18%

This composition is prepared by dissolving the sodium formate in water and thereafter adding the sodium alkyl ether ethylenoxy sulfate, the betaine and the ammonium lauryl sulfate while agitating moderately. The sodium alkyl ether ethylenoxy sulfate is added as an aqueous alcoholic solution containing 52.3% by weight of said sulfate and 13% by weight of ethanol. Additionally, both the betaine and the ammonium lauryl sulfate are added as aqueous solutions containing 30% by weight of said ingredient. Thereafter, a mixture of lauric-myristic monoethanolamide, sodium xylene sulfonate and water (40% by weight of amide, 24% by weight of sodium xylene sulfonate and 36% by weight of water) is added at a temperature of 40° C. to 47° C. in the presence of moderate agitation. Finally, perfume, color and sesquestrant are added with agitation and the pH is reduced from 8.1 to 7.35 with concentrated sulfuric acid.

The resultant product is a clear liquid at 25° C. having a specific gravity of 1.07 and a viscosity of 405 centipoises (cps) as measured with a Brookfield Viscometer, Model LVF, rotating at 12 rpm using a #1 spindle. Such product exhibits a cloud point of about 5° C. and is free of gelling tendencies upon exposure to the atmosphere for a period of twenty-four hours.

EXAMPLE 2

Examples 2A–2D which follow illustrate the effect of increased ethanol concentrations in the composition of Example 1 on the viscosity and cloud point of the resultant product. In these compositions, the additional ethanol replaced a light weight of water.

| Example | 2A | 2B | 2C | 2D |
|---|---|---|---|---|
| % ethanol | 4.5 | 5.0 | 5.5 | 6.0 |
| Viscosity (cps) | 300 | 255 | 200 | 165 |
| Cloud point (°C.) | 1 | 0 | 0 | 0 |

All of the foregoing compositions exhibited no gelling tendencies when left exposed to the atmosphere for up to twenty-four hours.

EXAMPLES 3–10

Other satisfactory single-phase liquid dishwashing compositions are described below:

| Ingredient | Example 3 | 4 | 5 | 6 | 7 | 8 | 9 | 10 |
|---|---|---|---|---|---|---|---|---|
| Alkyl ether ethylenoxy (6.5) sulfate salt | 16(a) | 16(a) | 16(a) | 16(a) | 16(a) | 16(b) | 16(b) | 16(b) |
| Ammonium lauryl sulfate | 6 | | | | | | | |
| Sodium linear dodecylbenzene sulfonate | | 6 | | | | | | |
| Sodium $C_{12}$–$C_{15}$ alkyl ether ethylenoxy (3) sulfate | | | 6 | | | | | |
| Sodium $C_{14}$–$C_{16}$ alpha olefin sulfonate | | | | 6 | | | | |
| Sodium lauryl sulfoacetate | | | | | 6 | | | |
| Disodium lauroylamidoisopropyl sulfosuccinate | | | | | | 8 | | |
| Sodium lauroyl isethionate | | | | | | | 8 | |
| Sodium $C_8$–$C_{18}$ acyl N—methyl taurate | | | | | | | | 8 |
| Cocoamidopropyldimethyl betaine | 4 | 4 | 4 | 4 | 4 | 4 | 4 | 4 |
| Lauric myristic monoethanolamide | 3 | 3 | 3 | 3 | 3 | 4 | 4 | 4 |
| Sodium xylene sulfonate | 5.4 | 5.4 | 5.4 | 5.4 | 5.4 | 5.4 | 6.5 | 6.5 |
| Ethanol | 8.1 | 8.1 | 9.5 | 8.1 | 8.1 | 9.6 | 9.6 | 9.6 |
| Water, perfume, color | | | | | balance | | | |

(a)Ammonium salt of $C_{12}$–$C_{13}$ (41%/57%) alkyl ethylenoxy ether sulfate
(b)Ammonium salt of $C_{12}$–$C_{14}$ (55%/45%) alkyl ethylenoxy ether sulfate The cleaning and foaming characteristics of the compositions Examples 1 and 3–10 are compared with two leading brands of dishwashing detergents, one of which is a leading mild dishwashing liquid, in the hand dishwashing evaluation test described herein. The performance results are set forth in Table I below:

TABLE I

| Composition | Number of Plates washed: Crisco Soil | Ragu Spaghetti Sauce Soil |
|---|---|---|
| Example 1 | 18 | 30 |
| Example 3 | 19 | 34 |
| Example 4 | 16 | 31 |
| Example 5 | 16 | 30 |
| Example 6 | 17 | 35 |
| Example 7 | 16 | 29 |
| Example 8 | 16 | 33 |
| Example 9 | 17 | 35 |
| Example 10 | 18 | 33 |
| Leading Brand A | 16 | 33 |
| Leading Brand B | 19 | 29 |

As shown by the results in the foregoing table, the compositions of the invention are characterized by cleaning and foaming properties which are equal to or superior to comparable commercial dishwashing liquids. Such results are particularly significant because the amounts of detergent active materials in leading Brands A and B are 34% and 33.5% respectively as compared with 29% for the compositions of Examples 1 and 3–7 and 32% for the compositions of Examples 8–10. Thus, the inventive composition exhibit an advantage based upon the performance obtained per part of detergent active material.

In order to evaluate the mildness properties of the compositions of this invention, two different tests are used. One test is an in vivo skin irritation test using quinea pigs. The second test is an in vivo skin irritation test on human subjects.

In the guinea pig test, the abdomen is shaved one day prior to the initiation of the test, an appropriate concentration of the product in water selected from the range of about 0.5% to 20% is selected for testing and one c.c. of the test solution is applied to the two separate areas about one square inch on the shaved abdomen of the test animal. Said area is covered with a patch which is removed after four hours. The foregoing procedure is repeated on the second and third days using different sites on the animal's abdomen. On the sixth day, any hair which has grown is removed with a commercial hair removing product and the test animal is thoroughly rinsed with water and dried. Four hours later each of the test sites is rated by a skilled observer for irritation, i.e., scaling, redness, cracking and visible sores, on a scale of 0–4. A rating of 0 corresponds to no irritation and a rating of 4 indicates visible sores and cracking. The ultimate irritation valve represents the average of six ratings. A difference in rating of 0.7–1 is considered to be significant.

In the in vivo test on human subjects, a panel of from 25 to 30 subjects is employed. Again, 0.2 ml. of a solution of the desired product concentration is applied to an area of approximately one square inch on the back of each subject and such area is covered with a patch. After 23½ hours the patch is removed and one-half hour later the degree of irritation at the test site is rated by a dermatologist using the 0 to 4 scale employed in the in vivo quinea pig test above. The test protocol is repeated fifteen more times, with the test solution being applied to the same test area each time. On weekends, the patch is not removed and the irritation is rated seventy-two hours after the preceeding application. Thus, sixteen readings are obtained over the course of a twenty-one day period. At the conclusion of the test, the cumulative score for each individual is determined and the irritation value for each product is equal to the sum of the scores of all of the members of the panel. Each panelist may wear up to 8 or 9 patches on his back and, therefore, up to nine products may be evaluated in a single test. The detailed test method is described in the article by Phillips et al. at pages 369–382 of the Journal of Toxicology and applied Pharmacology, 21 (1972).

Table 2 below shows some of the results from the in vivo quinea pig test.

TABLE 2

Irritation Scores in In Vivo Guinea Pig Test

| Composition | Irritation Score 2% Solution[a] | Irritation Score 3% Solution[a] |
|---|---|---|
| Example 3 | 1.5 | 1.4 |
| Example 4 | 0.9 | 1.0 |
| Example 6 | 1.2 | 1.5 |
| Leading Brand B | 2.2 | 3.0 |

[a]Concentration of the product in water

The test results clearly show that the inventive compositions are milder than Leading Brand B which is a leading mild liquid detergent.

The mildness of the inventive compositions is confirmed by the results obtained using a panel of twenty-five persons in the in vivo human subject test described above. In this test three concentrations of each of three products were determined and the results are shown in Table 3 below.

TABLE 3

Irritation Scores in In Vivo Human Test

| Composition | Irritation Score 1% Solution[a] | Irritation Score 5% Solution[a] | Irritation Score 10% Solution[a] |
|---|---|---|---|
| Example 1 | 31 | 25.5 | 38 |
| Example 3 | 55 | 74 | 73 |
| Leading Brand B | 50 | 73 | 135.5 |

[a]Concentration of the product in water

Based upon the foregoing results, the inventive compositions are as mild or milder than a leading mild brand, particularly at high concentrations. Such results substantially correspond to the results obtained in the in vivo guinea pig test and confirm the validity and utility of that test.

Two statistical analyses of the data summarized in Table 3 showed leading brand B to be significantly more irritating than either inventive product at the 10% concentration. Furthermore, a second statistical analysis of the data after deletion of the scores of a single subject who appeared to be a statistical outlier indicated leading brand B to be significantly more irritating than Example 1 at 1% and 5% concentrations. This second statistical analysis again indicated no statistical difference between the compositions of Examples 1 and 3.

EXAMPLES 11–16

The following compositions show the effect of increasing amounts of sodium xylene sulfonate solubilizer on the appearance and gelling tendencies of the inventive compositions:

| | 11 | 12 | 13 | 14 | 15 | 16 |
|---|---|---|---|---|---|---|
| Sodium $C_{12}$–$C_{14}$ alkyl ether ethylenoxy sulfate[a] | 16 | 16 | 16 | 16 | 16 | 16 |
| Ammonium lauryl sulfate | 6 | 6 | 6 | 6 | 6 | 6 |
| Cocoamidopropyl dimethyl betaine | | | | | | |
| Lauric-myristic monoethanolamide | 3 | 3 | 3 | 3 | 3 | 3 |
| Ethanol | 4 | 4 | 4 | 4 | 4 | 4 |
| Sodium xylene sulfonate | 2.8 | 3.8 | 4.8 | 5.8 | 6.8 | 7.8 |
| Water, color, perfume | | | balance | | | |
| | 100 | 100 | 100 | 100 | 100 | 100 |
| Appearance at 24° C. | Hazy | Clear | Clear | Clear | Clear | Clear |
| Gelling value | — | 74 | 57 | 33 | 0 | 0 |
| Cloud point (°C.) | — | — | — | — | — | 4° C. |

[a]Weight ratio of $C_{12}$ to $C_{14}$ is 55% to 45%.

These compositions show that a solubilizer is necessary to achieve clarity at room temperature (25° C.) and that gelling tendencies decrease as the concentration of sodium xylene sulfonate increases from 2.8% to 7.8% in combination with 4% of ethanol.

EXAMPLES 17–20

The composition of Example 1 is repeated with the exception that the concentration of sodium formate is changed from 6% to 4%, 8% and 10% respectively, with the concentration of water being adjusted accordingly. The resultant compositions are clear liquids at 25° C. and the effect of the concentration of sodium formate on the gelling value is set forth in Table 4.

TABLE 4

| % Sodium Formate | Gelling Value |
|---|---|
| 4% | 48 |
| 8% | 2 |
| 10% | 3 |

As the gelling value of the composition which does not contain any sodium formate is 76, it is clear that 4% or more of sodium formate is effective to reduce the gelling tendency.

EXAMPLES 21 AND 22

Other suitable compositions follow together with pertinent physical property information.

| | % by weight | |
|---|---|---|
| | 21 | 22 |
| Ammonium $C_{12}$–$C_{13}$ alkyl ethylenoxy (6.5) sulfate[a] | 16 | 16 |
| Ammonium lauryl sulfate | 6 | 6 |
| Cocoamidopropyldimethyl betaine | 4 | 4 |
| Lauric-myristic monoethanolamide | 3 | 3 |
| Ethanol | 3.1 | 3.1 |
| Sodium xylene sulfonate | 3.8 | 3.8 |
| HEDTA | 0.2 | 0.2 |
| Sodium formate | 5.0 | 3.0 |
| Water, perfume, color | balance | |
| | 100.0 | 100.0 |
| Appearance at 25° C. | Clear | Clear |
| Viscosity at 25° C. (cps.) | 340 | 26 |
| Specific gravity | 1.067 | 1.056 |
| Gelling value | 0 | 29 |

[a]Weight ratio of $C_{12}$ to $C_{13}$ is 41% to 57%

EXAMPLES 23–25

The following compositions containing lauric-myristic diethanolamide were clear liquids at 25° C., but exhibited gelling tendencies.

| | % by weight | | |
|---|---|---|---|
| | 23 | 24 | 25 |
| Sodium $C_{12}$–$C_{14}$ alkyl ether ethylenoxy (6.5) sulfate[a] | 16 | 16 | 16 |
| Sodium alpha $C_{14}$–$C_{16}$ alkenyl sulonate | 6 | 6 | 6 |
| Cocoamidopropyldimethylbetaine | 4 | 4 | 4 |
| Lauric myristic diethanolamide | 4 | 5 | 6 |
| Sodium xylene sulfonate | 3.8 | 3.8 | 3.8 |
| Ethanol | 4.7 | 4.7 | 4.7 |
| Hydroxyethyl ethylene diamine, triacetic acid, trisodium salt | 0.2 | 0.2 | 0.2 |
| Water, color, perfume | balance | | |
| | 100 | 100 | 100 |
| Viscosity at 25° C. (cps.) | 65 | 135 | 235 |

[a]Weight ratio of $C_{12}/C_{14}$ is 45% to 55%

EXAMPLES 26 AND 27

| | % by weight | |
|---|---|---|
| | 26 | 27 |
| Ammonium $C_{12}$–$C_{13}$ alkyl ether ethylenoxy (6.5) sulfate[a] | 16 | 16 |
| Disodium cocoamidoisopropyl sulfosuccinate | 8 | 8 |
| Cocoamidopropyldimethylbetaine | 4 | 4 |
| Lauric-myristic monoethanolamide | 4 | 4 |
| Sodium formate | — | 1.5 |
| Ethanol | 3.1 | 3.1 |
| Sodium xylene sulfonate | 2.4 | 2.4 |
| Water, perfume, color | balance | |
| | 100.0 | 100.0 |

-continued

| | % by weight | |
|---|---|---|
| | 26 | 27 |
| Appearance at 25° C. | Clear | Clear |
| Viscosity at 25° C. | 140 | 175 |
| Specific gravity | 1.052 | 1.070 |
| Gelling value | 5 | 4 |

[a]Weight ratio of $C_{12}$ to $C_{13}$ is 41% to 57%

In the hand dishwashing test, the composition with the same detergent actives as Example 26 washed 18 plates soiled with Crisco® and 33 plates soiled with Ragu® spaghetti sauce. These compositions also are effective when used to shampoo the hair or to wash the hands.

When either disodium oleylamidoisopropyl sulfosuccinate or disodium lauryl sulfosuccinate is substituted for the disodium cocoamidoisopropyl sulfosuccinate in the composition of Example 26, substantially identical dishwashing results are obtained.

EXAMPLES 28–30

Other suitable liquid compositions follow together with detergency results:

| | % by weight | | |
|---|---|---|---|
| | 28 | 29 | 30 |
| Sodium $C_{12}$–$C_{14}$ alkyl ether ethylenoxy (11.4) sulfate | 16 | 19 | |
| Sodium $C_{12}$–$C_{14}$ alkyl ether ethylenoxy (6.5) sulfate | | | 16 |
| Ammonium lauryl sulfate | 6 | — | — |
| Sodium dodecylbenzene sulfonate | — | 4 | — |
| Sodium lauroyl sarcosinate dimethyl | — | — | 6 |
| Cocoamidopropyl/betaine | 4 | 3 | 4 |
| Lauric-myristic mono-ethanolamide | 3 | 4 | 3 |
| Ethanol | 8.7 | 9.4 | 8.1 |
| Sodium xylene sulfonate | 5.4 | 6.2 | 5.4 |
| Water, perfume, color | balance | | |
| | 100 | 100 | 100 |
| Plates washed (Crisco)[R] | 16 | 14 | 15 |
| Plates washed (Ragu[R] sauce) | 33 | 28 | 31 |

EXAMPLES 31–34

Compositions containing other zwitterionic detergents follow together with plate washing results:

| | % by weight | | |
|---|---|---|---|
| | 31 | 32 | 33 |
| Ammonium $C_{12}$–$C_{13}$ alkyl ether ethylenoxy (6.5) sulfate[a] | 16 | 16 | 16 |
| Ammonium lauryl sulfate | 6 | 6 | 6 |
| 3-Cocamidopropyl dimethyl sulfobetaine | 4 | | |
| $C_8$–$C_{18}$ alkyl dimethyl betaine | | 4 | |
| Lauryldimethyl betaine | | | 4 |
| Lauric-myristic mono-ethanolamide | 3 | 3 | 3 |
| Ethanol | 8.1 | 8.1 | 8.1 |
| Sodium xylene sulfonate | 5.4 | 5.4 | 5.4 |
| Water, perfume, color | balance | | |
| | 100 | 100 | 100 |
| Plates washed (Crisco[R]) | 16 | 18 | 18 |

[a]Weight ratio of $C_{12}$ to $C_{13}$ is 41% to 47%

EXAMPLES 35–38

Other compositions suitable for use as foam baths, shampoos or dishwashing detergents follow:

| | % by weight | | | |
|---|---|---|---|---|
| | 35 | 36 | 37 | 38 |
| Ammonium $C_{12}$–$C_{14}$ alkyl ether ethylenoxy sulfate (6.5 EO) | 13 | 19 | 19 | 22 |
| Ammonium laurylsulfate | 2 | 6 | 2 | 4 |
| Cocoamidopropyldimethyl betaine | 4.5 | 1.5 | 4.5 | 3 |
| Lauric-myristic monoethanolamide | 1.5 | 4.5 | 4.5 | 3 |
| Ethanol | 9.2 | 11.2 | 11.2 | 12.1 |
| Sodium xylene sulfonate | 4.2 | 6.6 | 6.6 | 5.4 |
| Water, perfume, color | balance | | | |
| | 100 | 100 | 100 | 100 |
| Planchets washed (Crisco$^{(R)}$)$^{(b)}$ | 14 | 20 | 16 | 18 |

$^{(a)}$Weight ratio of $C_{12}$ to $C_{14}$ is 82% to 18%

$^{(b)}$Number of planchets washed using a Tergotometer foam test wherein aluminum planchets (1-inch diameter and ⅛ inch high) each soiled with one gram of Crisco$^{(R)}$ soil are added at two-minute intervals to 500 mls of solution containing 0.1% by weight of the test composition maintained at 50° C. In this test, an initial foam volume is generated by agitation of 250 ml of solution containing the test composition for five minutes followed by addition of 250 ml of water and a further one minute period of agitation. Agitation ceases for one minute during which period one planchet is added. Agitation resumes for one minute and then ceases for one minute, with the foam volume being read and a planchet being added while the agitator is stopped. This cycle is repeated until the surface is not completely covered with foam. The number of planchets washed prior to the end of the test is recorded. The number of planchets washed substantially corresponds to the number of plates washed inthe hand-dishwashing test.

The compositions of Examples 35–38 compare favorably with the dishwashing results for leading brand A—16 planchets—and for leading brand B—21 planchets.

EXAMPLE 39

| | % by weight |
|---|---|
| Ammonium $C_{12}$–$C_{13}$ alkyl ether ethylenoxy (6.5) sulfate | 20 |
| Ammonium Lauryl sulfate | 4 |
| Cocoamidopropyldimethyl betaine | 5 |
| Lauric-myristic mono-ethanolamide | 5 |
| HEDTA | 0.2 |
| Ethanol | 3.5 |
| Sodium xylene sulfonate | 5.3 |
| Sodium formate | 6 |
| Magnesium sulfate heptahydrate | 1 |
| Water, color, perfume | balance |
| | 100 |
| Appearance at 25° C. | Clear |
| Viscosity (cps.) | 250 |
| Specific gravity | 1.075 |
| Plates washed (Crisco$^{(R)}$) | 20 |
| Plates washed (Ragu$^{(R)}$sauce) | 36 |

The foregoing composition is higher foaming and exhibits better grease soil emulsification properties than leading brand B.

In its broadest form, the present invention relates to a high foaming detergent composition having reduced skin-irritation properties wherein the active detergent ingredient comprises a mixture of, by weight, 8 to 30 parts of an alkyl ether sulfate having the structural formula $$R(OC_2H_4)_nOSO_3M$$

wherein R is an alkyl of 10 to 16 carbon atoms, n has an average value of 5 to 12 and M is a cation; a supplementary, water-soluble, non-soap, anionic detergent having in its molecular structure a $C_7$—$C_{22}$ alkyl, alkenyl or acyl group and a sulfonate, sulfate or carboxylate group, the weight ratio of said alkyl ether sulfate to said supplementary degergent being in the range of 1:1 to 20:1, 1 to 8 parts of a zwitterionic detergent having the structural formula

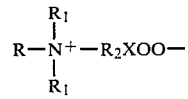

wherein R is a $C_8$—$C_{18}$ alkyl or $C_8$—$C_{18}$ alkanamido $C_2$—$C_3$ alkyl group, $R_1$ is a $C_1$—$C_3$ alkyl group, $R_2$ is a $C_1$—$C_4$ alkylene or hydroxyalkylene group and X is S:O or C, and 1 to 8 parts of an N-$C_8$—$C_{18}$ alkanoic acid $C_2$—$C_3$ alkanolamide, the weightratio of said alkanolamide to said zwitterionic detergent being in the range of 1:4 to 4:1. Such active ingredient mixture may be used in admixture with other ingredients normally found in high foaming detergent compositions, particularly those detergent compositions whose aqueous solutions come in contact with the skin or hair of the user.

The invention has been described with respect to various examples and illustrations thereof but is not to be limited to these because it is clear that one of skill in the art, with the present description before him, will be able to utilize substitutes and equivalents without departing from the invention.

What is claimed is:

1. A high foaming, liquid detergent composition having reduced skin-irritation properties which consists essentially of, by weight, 12% to 24% of alkyl ether sulfate having the structural formula $$R(OC(2)H(4))nOSO(3)M$$

wherein R is an alkyl of 10 to 16 carbon atoms, n has an average value of 5 to 12 and M is a cation; a supplementary, water-soluble, non-soap, anionic detergent having in its molecular structure a C(7)—C(22) alkyl, alkenyl or acyl group and a sulfonate, sulfate or carboxylate group, the weight ratio of said alkyl ether sulfate to said supplementary detergent being in the range of 1.5:1 to 6:1; 2% to 6% of a zwitterionic detergent having the structural formula

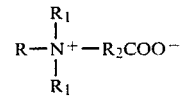

wherein R is C(8)—C(18) alkyl or C(8)—C(18) alkanamido C(2)—C(3) alkyl group, R1 is a C(1)—C(4) alkylene or hydroxylene group; 2% to 6% of an N-C(12)—C(14) alkanoic acid C(2)—C(3) alkanolamide, the weight ratio of said alkanolamide to said zwitterionic detergent being in the range of 1:2 to 2:1; and the balance being an aqueous medium containing 2% to 20% of a solubilizer.

2. A detergent composition according to claim 1 wherein said solubilizer is selected from the group consisting of $C_2$—$C_3$ monohydric and polyhydric alcohols, water-soluble $C_1$—$C_3$ alkyl substituted benzene sulfonate salts, urea and mixtures thereof.

3. A detergent according to claim 1 wherein said supplementary anionic detergent is selected from the group consisting of water-soluble salts of $C_8$—$C_{18}$ alkyl sulfates, $C_9$—$C_{15}$ alkylbenzene sulfonates, $C_8$—$C_{22}$ olefin sulfonates, $C_8$—$C_{18}$ alkyl ether ethylenoxy sulfates containing an average of 1 to 4 ethylene oxide groups, $C_{10}$—$C_{20}$ alkane sulfonates, $C_6$—$C_{12}$ alkylphenyl ether ethylenoxy sulfates containing an average of 2 to 6 ethylene oxide groups, $C_8$—$C_{18}$ alkyl sulfoacetates, N-mono-$C_8$—$C_{22}$ alkyl sulfosuccinates, N-$C_8$—$C_{18}$ acyl sarcosinates, N-$C_8$—$C_{18}$ acyl taurates and O-$C_8$—$C_{18}$ alkyl isethionates.

4. A detergent composition according to claim 3 which contains in addition from 2% to 10% by weight of an antigelling agent selected from the group consisting of sodium, ammonium or potassium formate, isethionate and mixtures thereof.

5. A detergent according to claim 4 wherein said antigelling agent is sodium formate.

6. A detergent composition according to claim 3 wherein the salt-forming cation of said alkyl ether sulfate and said supplementary anionic detergent is selected from the group consisting of sodium, potassium, ammonium and mono-, di-, or triethanolammonium.

7. A detergent composition according to claim 3 wherein said supplementary anionic detergent is a $C_8$—$C_{18}$ alkyl sulfate or a mono-$C_8$—$C_{22}$ alkyl sulfosuccinate.

8. A detergent composition according to claim 7 which contains in addition 2% to 10% of an antigelling agent selected from the group consisting of sodium or potassium formate, isethionate and mixtures thereof.

9. A detergent composition according to claim 8 wherein said antigelling agent is sodium formate.

10. A detergent composition according to claim 7 wherein said supplementary anionic detergent is sodium or ammonium $C_{10}$—$C_{16}$ alkyl sulfate which is present in an amount of 2% to 10% by weight, said zwitterionic detergent is $C_8$—$C_{18}$ alkanamidopropyldimethyl betaine and said alkanoic acid $C_2$—$C_3$ alkanolamide is $C_{12}$—$C_{14}$ alkanoic acid monoethanolamide.

* * * * *